US009395677B1

(12) United States Patent
Shirodai

(10) Patent No.: US 9,395,677 B1
(45) Date of Patent: Jul. 19, 2016

(54) IMAGE FORMING APPARATUS, IMAGE FORMATION SYSTEM AND CONTROL METHOD

(71) Applicant: Konica Minolta, Inc., Chiyoda-ku, Tokyo (JP)

(72) Inventor: Yasuo Shirodai, Tokyo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/016,576

(22) Filed: Feb. 5, 2016

(30) Foreign Application Priority Data

Feb. 19, 2015 (JP) ..... 2015-030622

(51) Int. Cl.
*G03G 15/00* (2006.01)
*G03G 21/00* (2006.01)

(52) U.S. Cl.
CPC ..... *G03G 21/0094* (2013.01)

(58) Field of Classification Search
USPC ..... 399/9, 24, 27–28, 38, 49, 72
See application file for complete search history.

(56) References Cited

U.S. PATENT DOCUMENTS

2013/0230332 A1* 9/2013 Ishii ..... G03G 15/556 399/27
2014/0086605 A1* 3/2014 Yoshida ..... G03G 15/234 399/45
2015/0037054 A1* 2/2015 Nagata ..... G03G 15/5058 399/49

FOREIGN PATENT DOCUMENTS

JP 2011-7831 A 1/2011

* cited by examiner

*Primary Examiner* — Hoan Tran
(74) *Attorney, Agent, or Firm* — Buchanan Ingersoll & Rooney PC

(57) ABSTRACT

An image forming apparatus determines the amount of lubricant to be applied to an image bearing member on the basis of a history of toner image formation by image forming section, and in accordance with a result thus determined, adjusts the charging amount of a toner patch image formed by a toner patch image formation section.

15 Claims, 5 Drawing Sheets

IMAGE FORMING APPARATUS, IMAGE FORMATION SYSTEM AND CONTROL METHOD

CROSS REFERENCE TO RELATED APPLICATIONS

This application is entitled to and claims the benefit of Japanese Patent Application No. 2015-030622, filed on Feb. 19, 2015, the disclosure of which including the specification, drawings and abstract is incorporated herein by reference in its entirety.

BACKGROUND OF THE INVENTION

1. Field of the Invention

The present invention relates to an image forming apparatus, an image formation system and a control method.

2. Description of Related Art

In an image forming apparatus using an electrophotographic scheme, a cleaning device of a blade-cleaning type has been used in which a plate-shaped cleaning blade composed of an elastic body and serving as a device for removing remaining toner such as untransferred toner and transfer residual toner on an image bearing member (for example, photoconductor) is brought into contact with the surface of an image bearing member to remove the remaining toner on the image bearing member, for example.

In recent years, reduction of toner particle size has been demanded from the view point of enhancing the image quality, and for such a purpose, polymerization methods such as the emulsion polymerization method and the suspension polymerization method have been utilized, for example. As the size of the toner particle decreases, however, the attaching force between the toner particle and the image bearing member increases, thus reducing the ease of removal of the remaining toner on the image bearing member. In particular, when so-called polymerization toner produced by a polymerization method is used, the toner particles have a substantially spherical shape, and as a result cleaning defects in which the toner particles roll on the image bearing member and slip through the cleaning blade is easily caused, thus further reducing the ease of removal of the remaining toner on the image bearing member.

In addition, when toner slips through the cleaning blade, the toner becomes the core of toner aggregate formed on the image bearing member, and grain blank (grain noise) is generated on the solid image printing part. To solve such a quality problem as the above-mentioned "grain noise," today, lubricant is supplied onto the image bearing member to form coating of the lubricant such that cleaning is performed in the state where the attaching force between the toner particle and the image bearing member is suppressed to a low level. Examples of the approach for supplying lubricant on the image bearing member include a lubricant application process in which a brush is brought into contact with lubricant formed in a rod shape to scrape the lubricant and supply the lubricant to the surface of the image bearing member; and a toner adding process in which a toner image is formed with use of toner containing lubricant-external additive (lubricant) to supply the lubricant.

The toner adding process does not require a coating device such as a lubricant rod and a brush and therefore is advantageous in terms of installation space and cost. In the toner adding process, however, the amount of the lubricant in the developing device varies depending on the toner consumption amount, and as a result the amount of the lubricant to be applied onto the image bearing member varies. To be more specific, when an image having a low coverage rate is printed, only the lubricant separated from the toner is preferentially consumed at background parts, and new toner (lubricant) is not supplied to the developing device. Therefore, finally, supply and ejection of the lubricant are balanced and stabilized in the state where the amount of the lubricant in the developing device is reduced. Since only the lubricant is supplied at first, the level of the lubricant on the image bearing member can be maintained at a certain level. However, when the amount of the lubricant in the developing device is reduced, the amount of the lubricant supplied to the surface of the image bearing member is reduced and in turn, the covering rate is reduced. Consequently, the adhering amount between the toner particle and the image bearing member cannot be reduced, and as a result grain noise may be generated.

Conventionally, after an image having a low coverage rate is printed, a toner patch image is formed on the image bearing member in a region outside the image formation region to maintain the amount of the lubricant in the developing device. When the toner patch image is formed, the toner in the developing device is consumed, and the developing device is replenished with new toner. When the toner is supplied, lubricant is also supplied together with the toner, and thus reduction of the amount of the lubricant in the developing device can be suppressed. As a result, reduction of the amount of the lubricant on the image bearing member can be suppressed. Conversely, after an image having a high coverage rate is printed, the amount of the lubricant on the image bearing member increases as lubricant is supplied into the developing device together with the toner. When the amount of the lubricant on the image bearing member is excessively increased, the cleaning blade makes close contact with the image bearing member with the lubricant therebetween, and consequently problems such as turn-up of the blade are caused. That is, the amount of the lubricant on the image bearing member has its proper range, and therefore the amount of the lubricant is required to be stabilized.

It is known that the toner patch image has an effect of abrasion of the lubricant applied on the image bearing member (abrasion effect), and an effect of supplying lubricant together with toner onto the image bearing member (supply effect). The amount of the abrasion depends on the amount of scraping and removing the lubricant applied on the surface of the image bearing member. The supplying amount depends on the amount of toner supplied onto the image bearing member, and the amount of the lubricant removed from the toner. Which of the abrasion effect and the supply effect is obtained depends on the balance between the abrasion amount and the supplying amount. In view of this, toner patch image is used paying attention to one of the effects to be obtained in accordance with the system and condition.

Japanese Patent Application Laid-Open No. 2011-7831 discloses a technique for improving the cleaning performance by maintaining the amount of the lubricant on the surface of a photoconductor in an image forming apparatus of a contact transfer type without requiring improvement of the cleaning performance of the transfer section (transfer belt). In the technique disclosed in Japanese Patent Application Laid-Open No. 2011-7831, a toner image based on a toner forcible-ejection patch is formed in a non-image region on the photoconductor with use of toner mixed with lubricant for lubricating the surface of the photoconductor, and the polarity of the transfer belt is changed to a polarity same as the polarity of the toner having at the time when the non-image region of the photoconductor makes contact with a transfer belt, whereby the toner image is prevented from being transferred to the transfer belt.

However, since the effect obtained with the toner patch image depends on the balance between the abrasion effect and the supply effect, the desired effect may not always be obtained. When the desired effect cannot be obtained, it has been difficult to suppress the variation of the amount of the lubricant to be applied to the image bearing member to maintain the lubricant within a proper range. For example, after a large number of high-coverage rate images are formed, the abrasion effect is desirably obtained through formation of the toner patch image; however, the supply effect may instead be exhibited and consequently turn-up of the blade may be caused due to an excessive amount of the lubricant. In addition, after a large number of low-coverage rate images are formed, the supply effect is desirably obtained through formation of the toner patch image; however, the abrasion effect may instead be exhibited, and consequently grain unevenness may be caused due to an insufficient amount of the lubricant. As described, with the conventional techniques, the effects obtained with the toner patch image could not have been appropriately controlled.

Japanese Patent Application Laid-Open No. 2011-7831 discloses a technique for maintaining the amount of lubricant on the surface of the image bearing member. However, Japanese Patent Application Laid-Open No. 2011-7831 does not states that which of the abrasion effect and the supply effect is obtained with formation of the toner patch image, which is prerequisite technique to solve the above-mentioned problems, and therefore, the above-mentioned problems cannot be solved with the technique disclosed in Japanese Patent Application Laid-Open No. 2011-7831.

SUMMARY OF THE INVENTION

An object of the present invention is to provide an image forming apparatus, an image formation system and a control method which can maintain the amount of the lubricant to be applied to an image bearing member within a proper range.

To achieve the abovementioned object, an image forming apparatus reflecting an aspect of the present invention includes: a first image bearing member which is rotatable; an image forming section configured to form a toner image on the first image bearing member with use of toner mixed with lubricant, and apply a transfer bias when the toner image passes through a transfer nip to transfer the toner image to a second image bearing member; a toner patch image formation section configured to form a toner patch image with use of the toner mixed with the lubricant in a patch formation region located between toner image formation regions in a rotational direction of the first image bearing member on a surface of the first image bearing member; a cleaning member configured to make contact with the first image bearing member and remove toner which remains on the first image bearing member without being transferred to the second image bearing member; a charging amount adjusting section provided on an upstream side of the cleaning member in the rotational direction of the first image bearing member, and configured to adjust a charging amount of the toner patch image formed by the toner patch image formation section; a storage section configured to store history information representing a history of formation of the toner image of the image forming section; and a control section configured to determine an amount of the lubricant to be applied to a surface of the first image bearing member on a basis of the history information stored in the storage section, and in accordance with a result thus determined, adjust the charging amount of the toner patch image.

Desirably, in the image forming apparatus, when it is determined that the amount of the lubricant to be applied to the surface of the first image bearing member is large, the control section adjusts the charging amount such that an absolute value of the charging amount of the toner patch image formed by the toner patch image formation section is greater than an absolute value of a charging amount of a toner patch image which reaches the cleaning member without being subjected to adjustment of the charging amount.

Desirably, in the image forming apparatus, when it is determined that the amount of the lubricant to be applied to the surface of the first image bearing member is small, the control section adjusts the charging amount such that an absolute value of the charging amount of the toner patch image formed by the toner patch image formation section is smaller than an absolute value of a charging amount of a toner patch image which reaches the cleaning member without being subjected to adjustment of the charging amount.

Desirably, in the image forming apparatus, the control section operates such that the transfer bias that is applied at a time when the toner patch image formed by the toner patch image formation section passes through the transfer nip is smaller than the transfer bias that is applied at a time when the toner image formed by the image forming section passes through the transfer nip.

Desirably, in the image forming apparatus, when a coverage rate of the toner image formed by the image forming section is small, the control section operates such that an area of the toner patch image to be formed on the first image bearing member is large in comparison with a case where the coverage rate of the toner image is large on a basis of the history information stored in the storage section.

An image formation system reflecting another aspect of the present invention is composed of a plurality of units including an image forming apparatus, the image formation system includes: a first image bearing member which is rotatable; an image forming section configured to form a toner image on the first image bearing member with use of toner mixed with lubricant, and apply a transfer bias when the toner image passes through a transfer nip to transfer the toner image to a second image bearing member; a toner patch image formation section configured to form a toner patch image with use of the toner mixed with the lubricant in a patch formation region located between toner image formation regions in a rotational direction of the first image bearing member on a surface of the first image bearing member; a cleaning member configured to make contact with the first image bearing member and remove toner which remains on the first image bearing member without being transferred to the second image bearing member; a charging amount adjusting section provided on an upstream side of the cleaning member in the rotational direction of the first image bearing member, and configured to adjust a charging amount of the toner patch image formed by the toner patch image formation section; a storage section configured to store history information representing a history of formation of the toner image of the image forming section; and a control section configured to determine an amount of the lubricant to be applied to a surface of the first image bearing member on a basis of the history information stored in the storage section, and in accordance with a result thus estimated, adjust the charging amount of the toner patch image.

Desirably, in the image formation system, when it is determined that the amount of the lubricant to be applied to the surface of the first image bearing member is large, the control section adjusts the charging amount such that an absolute value of the charging amount of the toner patch image formed by the toner patch image formation section is greater than an absolute value of a charging amount of a toner patch image which reaches the cleaning member without being subjected to adjustment of the charging amount.

Desirably, in the image formation system, when it is determined that the amount of the lubricant to be applied to the surface of the first image bearing member is small, the control section adjusts the charging amount such that an absolute value of the charging amount of the toner patch image formed by the toner patch image formation section is smaller than an absolute value of a charging amount of a toner patch image which reaches the cleaning member without being subjected to adjustment of the charging amount.

Desirably, in the image formation system the control section operates such that the transfer bias that is applied at a time when the toner patch image formed by the toner patch image formation section passes through the transfer nip is smaller than the transfer bias that is applied at a time when the toner image formed by the image forming section passes through the transfer nip.

Desirably, in the image formation system the control section operates such that an area of the toner patch image to be formed on the first image bearing member is large in comparison with a case where the coverage rate of the toner image is large when a coverage rate of the toner image formed by the image forming section is small on a basis of the history information stored in the storage section.

In a method of controlling an image forming apparatus reflecting another aspect of the present invention, the image forming apparatus includes: a first image bearing member which is rotatable; an image forming section configured to form a toner image on the first image bearing member with use of toner mixed with lubricant, and apply a transfer bias when the toner image passes through a transfer nip to transfer the toner image to a second image bearing member; a toner patch image formation section configured to form a toner patch image with use of the toner mixed with the lubricant in a patch formation region located between toner image formation regions in a rotational direction of the first image bearing member on a surface of the first image bearing member; and a cleaning member configured to make contact with the first image bearing member and remove toner which remains on the first image bearing member without being transferred to the second image bearing member, the method including: determining an amount of the lubricant to be applied to a surface of the first image bearing member on a basis of history information representing a history of formation of the toner image of the image forming section; and adjusting the charging amount of the toner patch image formed by the toner patch image formation section in accordance with a result of the determining.

Desirably, in the method, when it is determined that the amount of the lubricant to be applied to the surface of the first image bearing member is large, the charging amount is adjusted such that an absolute value of the charging amount of the toner patch image formed by the toner patch image formation section is greater than an absolute value of a charging amount of a toner patch image which reaches the cleaning member without being subjected to adjustment of the charging amount.

Desirably, in the method, when it is determined that the amount of the lubricant to be applied to the surface of the first image bearing member is small, the charging amount is adjusted such that an absolute value of the charging amount of the toner patch image formed by the toner patch image formation section is smaller than an absolute value of a charging amount of a toner patch image which reaches the cleaning member without being subjected to adjustment of the charging amount.

Desirably, in the method the transfer bias that is applied at a time when the toner patch image formed by the toner patch image formation section passes through the transfer nip is set to a value smaller than the transfer bias that is applied at a time when the toner image formed by the image forming section passes through the transfer nip.

Desirably, in the method, when a coverage rate of the toner image formed by the image forming section is small, the toner patch image to be formed on the first image bearing member is set to have a large area in comparison with a case where the coverage rate of the toner image is large on a basis of the history information stored in the storage section.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENT

Figure 1:
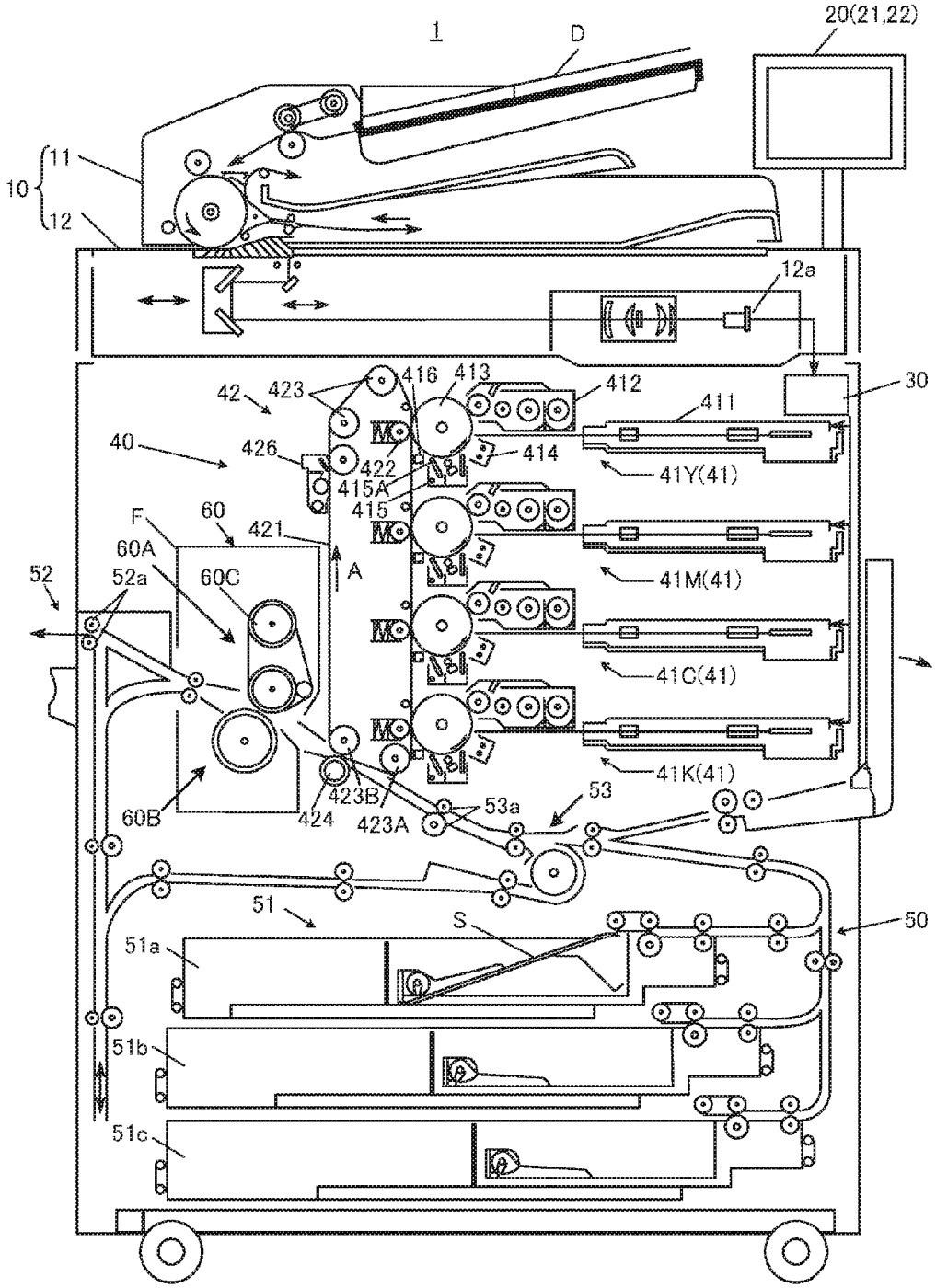
FIG. 1 schematically illustrates a general configuration of an image forming apparatus according to an embodiment.
Figure 2:
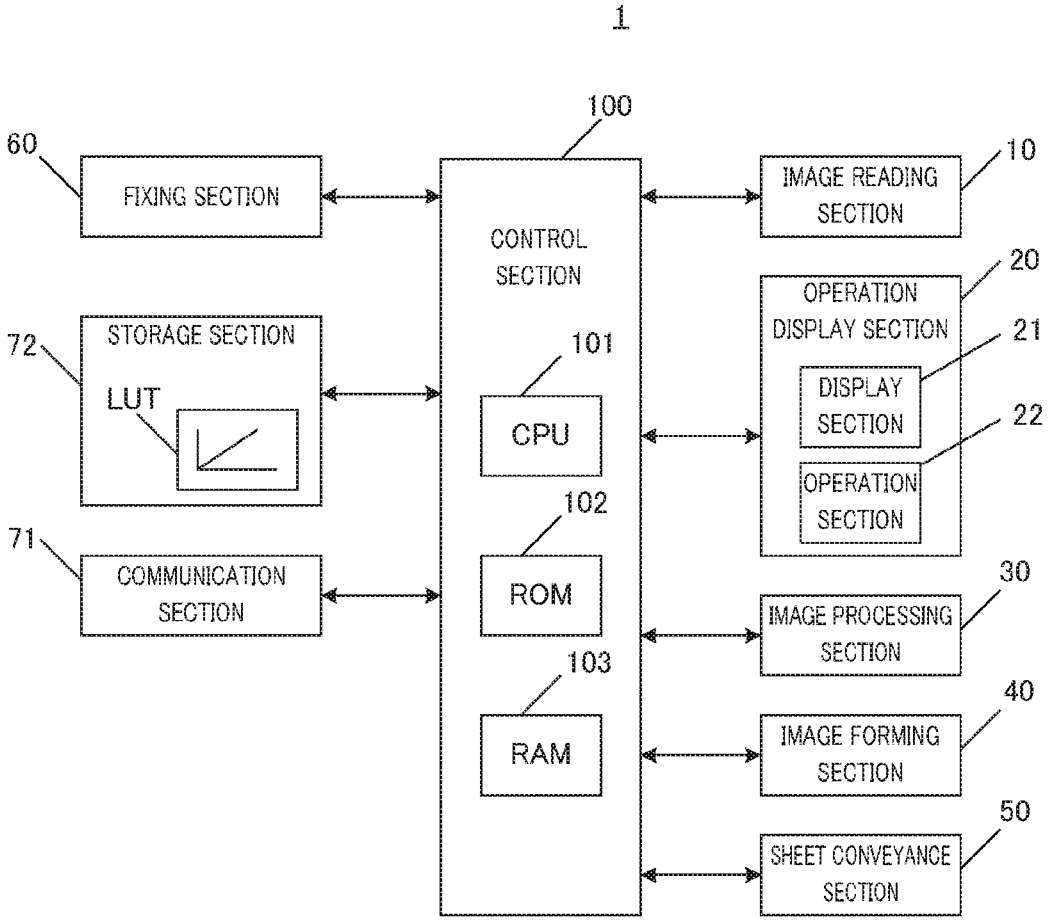
FIG. 2 illustrates a principal part of a control system of the image forming apparatus according to the embodiment.

In the following, the present embodiment is described in detail with reference to the drawings. FIG. 1 illustrates an overall configuration of image forming apparatus 1 according to the embodiment of the present invention. FIG. 2 illustrates a principal part of a control system of image forming apparatus 1 according to the embodiment. Image forming apparatus 1 illustrated in FIGS. 1 and 2 is a color image forming apparatus of an intermediate transfer system using electrophotographic process technology. That is, image forming apparatus 1 transfers (primary-transfers) toner images of yellow (Y), magenta (M), cyan (C), and black (K) formed on photoconductor drums 413 (corresponding to "first image bearing member" of the embodiment of the present invention) to intermediate transfer belt 421 (corresponding to "second image bearing member" of the embodiment of the present invention), and superimposes the toner images of the four colors on one another on intermediate transfer belt 421. Then, image forming apparatus 1 transfers (secondary-transfers) the resultant image to sheet S, to thereby form an image.

A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

As illustrated in FIG. 2, image forming apparatus 1 includes image reading section 10, operation display section 20, image processing section 30, image forming section 40, sheet conveyance section 50, fixing section 60 and control section 100.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive. In the present embodiment, storage section 72 stores history information that represents the history of toner image formation of image forming section 40. The history information includes information on the number of prints and the coverage rate the like.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet S on the basis of the image data (input image data). Communication section 71 is composed of, for example, a communication control card such as a LAN card.

Image reading section 10 includes auto document feeder (ADF) 11, document image scanning device 12 (scanner), and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Controls display section 21 to displays various operation screens, image conditions, operating statuses of functions, and the like in accordance with display control signals received from control section 100. Operation section 22 includes various operation keys such as numeric keys and a start key, receives various input operations performed by a user, and outputs operation signals to control section 100.

Image processing section 30 includes a circuit that performs a digital image process suited to initial settings or user settings on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data that has been subjected to the processes.

Image forming section 40 includes: image forming units 41Y, 41M, 41C, and 41K that form images of colored toners of a Y component, an M component, a C component, and a K component on the basis of the input image data; intermediate transfer unit 42; and the like. It is to be noted that image forming section 40 corresponds to the "image forming section" and the "toner patch image formation section" of the embodiment of the present invention.

Image forming units 41Y, 41M, 41C, and 41K for the Y component, the M component, the C component, and the K component have a similar configuration. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes light exposure device 411, developing adjustment 412, photoconductor drum 413, charging apparatus 414, drum cleaning device 415, charging amount adjusting section 416, and the like.

Photoconductor drum 413 is composed of an organic photoconductor in which a photosensitive layer made of a resin containing an organic photoconductive member is formed on the outer peripheral surface of a drum-like metal base, for example. Examples of the resin of the photosensitive layer include polycarbonate resin, silicone resin, polystyrene resin, acrylic resin, methacryl resin, epoxy resin, polyurethane resin, chloride vinyl resin, melamine resin and the like.

Control section 100 controls a driving current supplied to a driving motor (not shown in the drawings) that rotates photoconductor drums 413, whereby photoconductor drums 413 is rotated at a constant circumferential speed.

Charging device 414 is, for example, a charging charger and causes corona discharge to thereby evenly negatively charge the surface of photoconductor drum 413 having photoconductivity.

Exposure device 411 is composed of, for example, a semiconductor laser, and configured to irradiate photoconductor drum 413 with laser light corresponding to the image of each color component. As a result, Electrostatic latent images for the respective color components are formed on the surface of photoconductor drum 413 due to a potential difference from the surrounding area.

Developing device 412 is a developing device of a two-component reverse type, and attaches toners of respective color components to the surface of photoconductor drums 413, and visualizes the electrostatic latent image to form a toner image. In the present embodiment, lubricant having lubricity is added in the toner. Examples of the lubricant include fatty acid metal salt, silicone oil, fluorine resin and the like, which may be used alone or in combination. Among them, fatty acid metal salt is preferable. The fatty acid is preferably a straight-chain hydrocarbon, and for example, myristic acid, palmitic acid, stearic acid, oleic acid and the like are preferable. Among them, stearic acid is more preferable. Examples of the metal include lithium, magnesium, calcium, strontium, zinc, cadmium, aluminum, celium, titanium, and iron. Among them, zinc stearate, stearic acid magnesium, stearic acid aluminum, stearic acid iron and the like are preferable, and zinc stearate is most preferable. In the present embodiment, 0.2 pts. wt. of zinc stearate is added based on the toner weight.

Developing device 412 includes a developing sleeve that is disposed to face photoconductor drum 413 with the development region therebetween. For example, a direct current developing bias having a polarity same as the charging polarity of charging apparatus 414, or a developing bias in which a direct current voltage having a polarity same as the charging polarity of charging apparatus 414 is superimposed on an alternating current voltage is applied to the developing sleeve. Thus, reversal development for attaching toner to an electrostatic latent image formed by exposing device 411 is performed.

Drum cleaning device 415 is brought into contact with the surface of photoconductor drum 413. Drum cleaning device 415 includes a plate-shaped drum cleaning blade 415A (which corresponds to "cleaning member" of the embodiment of the present invention) composed of an elastic body and the like, and removes the toner remaining on the surface of photoconductor drum 413 which has not been transferred to intermediate transfer belt 421.

The impact resilience coefficient and the hardness are important physical properties of drum cleaning blade 415A. The impact resilience coefficient at a temperature of 25° C. is preferably 10 to 80%, more preferably 30 to 70%. In addition, the JISA hardness is preferably 20 to 90 degrees, more preferably 60 to 80 degrees. When the JISA hardness is smaller than 20 degrees, drum cleaning blade 415A is excessively soft, and turn-up of the blade is easily caused. When the JISA hardness is greater than 90 degrees, it is difficult to follow the slight irregularities and foreign matters on of photoconductor drum 413, and consequently toner particles may easily slip therethrough. The contact load of drum cleaning blade 415A on photoconductor drum 413 is preferably 0.1 to 40 N/m, more preferably 1 to 25 N/m. When the contact load is smaller than 0.1 N/m, the cleaning force is insufficient, and consequently image fouling is easily caused. When the contact load is greater than 40 N/m, abrasion of photoconductor drum 413 is increased, and consequently image blurring and the like are easily caused. The examples of the method for measuring the contact load include: a method in which the contact load is measured by pressing the tip of drum cleaning blade 415A against a balance; a method in which the contact load is electrically measured by disposing a sensor such as a load cell at a position where the tip of drum cleaning blade 415A makes contact with photoconductor drum 413; and the like.

Charging amount adjusting section 416 is disposed on the upstream side of drum cleaning blade 415A and on the downstream side of the primary transfer nip in the rotational direction of photoconductor drum 413, and adjusts the charging amount of the toner remaining on the surface of photoconductor drum 413 which has not been transferred to intermediate transfer belt 421. Charging amount adjusting section 416 may be provided in any form as long as the toner charging amount can be adjusted, and charging amount adjusting section 416 may be: a corotron charger, a scorotron charger, a discharging needle, a discharging cloth using a non-woven fabric or the like which utilize corona discharging; an electrode or a roller disposed to face photoconductor drum 413 with a minute space provided thereto; a contacting roller; or the like. The voltage to be applied during adjustment of charging amount may be a direct current voltage, an alternating current voltage, or a direct current voltage on which an alternating current voltage is superimposed. In addition, since charging amount adjusting section 416 is a part for adjusting the charging amount of the toner that reaches drum cleaning blade 415A, charging amount adjusting section 416 may be provided at any position preceding drum cleaning blade 415A from developing device 412.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer nip can be easily maintained at a constant speed. When driving roller 423A rotates, intermediate transfer belt 421 travels in arrow A direction at a constant speed.

Intermediate transfer belt 421 is a belt having conductivity and elasticity which includes on the surface thereof a high resistance layer having a volume resistivity of 8 to 11 log Ω·cm. Intermediate transfer belt 421 is rotationally driven by a control signal from control section 100. It is to be noted that the material, thickness and hardness of intermediate transfer belt 421 are not limited as long as intermediate transfer belt 421 has conductivity and elasticity.

Primary transfer rollers 422 are disposed to face photoconductor drums 413 of respective color components, on the inner periphery side of intermediate transfer belt 421. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to secondary transfer roller 424, and an electric charge of the polarity opposite to the polarity of the toner is applied to the rear side (the side that makes contact with secondary transfer roller 424) of sheet S, whereby the toner image is electrostatically transferred to sheet S. Sheet S on which the toner images have been transferred is conveyed toward fixing section 60.

Belt cleaning device 426 removes transfer residual toner which remains on the surface of intermediate transfer belt 421 after a secondary transfer. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes upper fixing section 60A having a fixing side member disposed on a fixing surface (the surface on which a toner image is formed) side of sheet S, lower fixing section 60B having a back side supporting member disposed on the rear surface (the surface opposite to the fixing surface) side of sheet S, heating source 60C, and the like. The back side supporting member is brought into pressure contact with the fixing side member, whereby a fixing nip for conveying sheet S in a tightly sandwiching manner is formed.

Fixing section 60 applies, at the fixing nip, heat and pressure to sheet S on which a toner image has been secondary-transferred, thereby fixing the toner image on sheet S. Fixing section 60 is disposed as a unit in fixing part F. In addition, fixing part F may be provided with an air-separating unit that blows air to separate sheet S from the fixing side member or the back side supporting member.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 includes a plurality of pairs of conveyance rollers such as a pair of registration rollers 53*a*.

The recording sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet ejection rollers 52*a*.

In the present embodiment, after forming an image having a low-coverage rate, image forming section 40 forms a toner patch image on the surface of photoconductor drum 413 in a patch formation region between toner image formation regions in which the toner image corresponding to the input image data is formed in the rotational direction of photoconductor drum 413 to maintain the amount of the lubricant in developing device 412. That is, the patch formation region is located between a toner image formation region and a following toner image formation region (between images). The toner patch image has a width equal to or greater than that of the toner formation region in the axial direction of photoconductor drum 413.

When a toner patch image is formed, the toner in developing device 412 is consumed, and then new toner is supplied to developing device 412. When toner is supplied, lubricant is also supplied together with the toner, and thus the amount of the lubricant in developing device 412 can be prevented from decreasing. As a result, it is possible to suppress the reduction of the amount of the lubricant on photoconductor drum 413. Conversely, after a high-coverage rate image is formed, the amount of the lubricant on photoconductor drum 413 increases in association with supply of lubricant together with the toner to developing device 412. When the amount of the lubricant on photoconductor drum 413 is excessively increased, drum cleaning blade 415A makes close contact with the lubricant through photoconductor drum 413, and consequently turn-up of the blade is caused. That is, the amount of the lubricant on photoconductor drum 413 has its proper range, and therefore the amount of the lubricant is required to be stabilized.

It is known that the toner patch image has an effect of abrasion of the lubricant applied on photoconductor drum 413 (abrasion effect), and an effect of supplying lubricant together with toner onto photoconductor drum 413 (supply effect). The amount of abrasion depends on the amount of the lubricant applied on the surface of photoconductor drum 413 that is scraped and taken out when the toner rolls at the edge of drum cleaning blade 415A. The supplying amount depends on the amount of the lubricant attached to the toner to be supplied since the toner rolls at the edge of drum cleaning blade 415A, and the lubricant is removed from the toner and supplied to photoconductor drum 413. In view of this, toner patch image is used paying attention to one of the effects to be obtained in accordance with the system and condition.

However, which of the abrasion effect and the supply effect is obtained with the toner patch image depends on the balance between the abrasion effect and the supply effect, and therefore the desired effect may not always be obtained. When the desired effect is not obtained, it is difficult to suppress the variation of the amount of the lubricant to be applied to photoconductor drum 413 to maintain the amount of the lubricant within the proper range. For example, after a large number of high-coverage rate images are formed, the abrasion effect is desirably obtained through formation of the toner patch image; however, the supply effect may instead be exhibited and consequently turn-up of the blade may be caused due to an excessive amount of the lubricant. In addition, after a large number of low-coverage rate images are formed, the supply effect is desirably obtained through formation of the toner patch image; however, the abrasion effect may instead be exhibited, and consequently grain unevenness may be caused due to an insufficient amount of the lubricant.

In view of this, in the present embodiment, control section 100 adjusts the charging amount of the toner patch image such that the abrasion effect or the supply effect or both of the toner patch image is surely obtained as desired so as to maintain the amount of the lubricant to be applied to photoconductor drum 413 within a proper range.

First, a result of an experiment for confirming which of the abrasion effect and the supply effect is obtained in accordance with the charging amount of the toner patch image will be described. In this experiment, on 1,000 A4-sheets, a character pattern (image) having a coverage rate of 20% was formed, and a horizontal linear toner patch image corresponding to the coverage rate of 10% was formed. In this case, a predetermined transfer bias (−500 V) is set to be applied at the time when the toner patch image passes through the primary transfer nip to leave a toner patch image on photoconductor drum 413. In the case where adjustment of the charging amount by charging amount adjusting section 416 is not performed, the charging amount of the toner patch image that reaches drum cleaning blade 415A was −25 μC/g (hereinafter referred to as "standard (normal) charging amount"). The charging amount of the toner patch image was calculated as follows: image forming section 40 was forcibly stopped after the toner patch image had passed through charging amount adjusting section 416; photoconductor drum 413 was connected to an ammeter (KEYTHLEY6514 systemelectorometer); the toner patch image was absorbed before the image reaches drum cleaning blade 415A to obtain the electric charge movement amount; and the electric charge movement amount and the toner weight at this time were converted to calculate the charging amount of the toner patch image.

Figure 3:
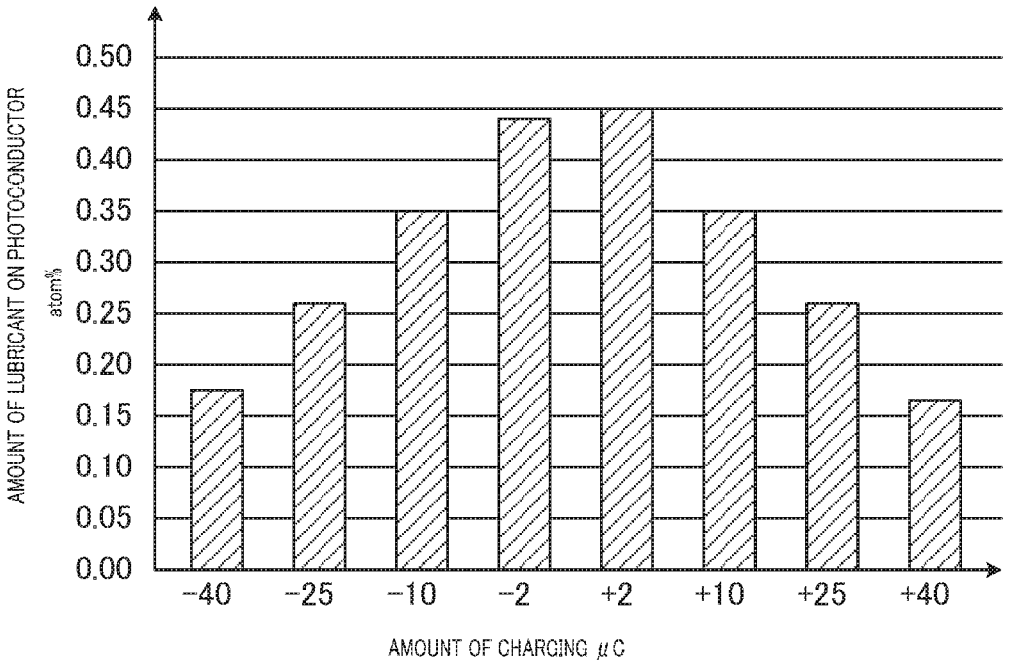
FIG. 3 shows the amount of lubricant on a photoconductor drum corresponding to a charging amount of a toner patch image.

As shown in FIG. 3, control section 100 controlled charging amount adjusting section 416 to adjust the charging amount of the toner patch image in the range of +40 μC to −40 μC. FIG. 3 shows the relationship between the amount of the lubricant on photoconductor drum 413 and the charging amount of the toner patch image. The amount of lubricant was determined as follows: the surface layer of photoconductor drum 413 having passed through drum cleaning blade 415A was cut out after image formation on 1,000 A4-sheets; and the ratio of zinc in zinc stearate determined at the layer thus cut out with use of an X-ray photoelectron spectral analysis device was utilized as the amount of lubricant. It is to be noted that the evaluation was made with use of developing device 412 provided with new toner in consideration of variation in the amount of the lubricant in developing device 412 through the endurance (process of image formation on 1,000 A4-sheets) when the charging amount shown in FIG. 3 is obtained by adjusting the charging amount of the toner patch image. As is obvious from the result shown in FIG. 3, the amount of the lubricant on photoconductor drum 413 is reduced when the absolute value of the charging amount of the toner patch image that reaches drum cleaning blade 415A is increased, and the amount of the lubricant on photoconductor drum 413 is increased when the absolute value of the charging amount of the toner patch image is reduced. Regarding the above-described abrasion effect, since the abrasion force depends on the frictional force between the toner and photoconductor drum 413, the abrasion force can be adjusted by adjusting the frictional force. In addition, since the frictional force between the toner and photoconductor drum 413 depends on the attaching force between the toner and photoconductor drum 413, the image force (electrostatic force that acts between the toner and photoconductor drum 413) can be increased by adjusting the charging amount of toner to control the abrasion force. Regarding the above-described supply effect, the adjustment of the charging amount of toner hardly affects removal of the lubricant from the toner. Therefore, the amount of the lubricant on photoconductor drum 413 depends on the balance between the abrasion effect and the supply effect, and the amount of the lubricant on photoconductor drum 413 is reduced when the relationship of abrasion effect>supply effect is satisfied, or in other words, when the frictional force, that is, the abrasion force, is high because of a high absolute value of the charging amount of the toner. On the other hand, the amount of the lubricant on photoconductor drum 413 is increased when the relationship of abrasion effect<supply effect is satisfied, or in other words, when the frictional force, that is, the abrasion force, is low because of a low absolute value of the charging amount of the toner.

Figure 4A:
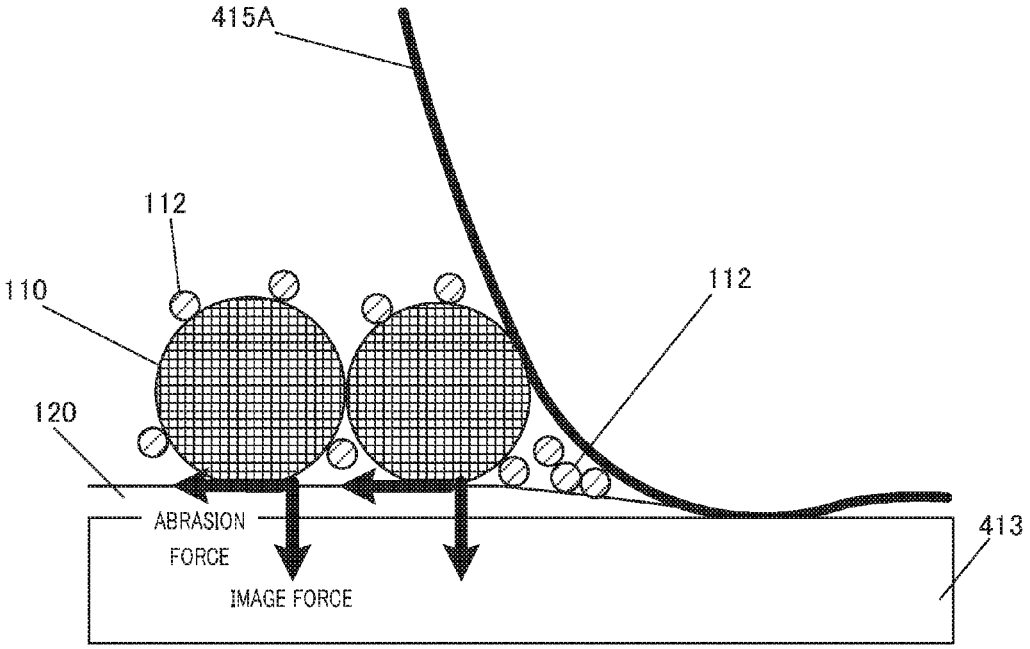
FIGS. 4A and 4B are explanatory diagrams of an abrasion effect and a supply effect of formation of a toner patch image.

FIG. 4A illustrates a state where toner 110 rolls at the edge of drum cleaning blade 415A and thus lubricant 120 applied on the surface of photoconductor drum 413 is scraped by lubricant particle 112 supplied together with toner 110 when the absolute value of the charging amount of toner 110 is high and the relationship of abrasion effect>supply effect is satisfied.

Figure 4B:
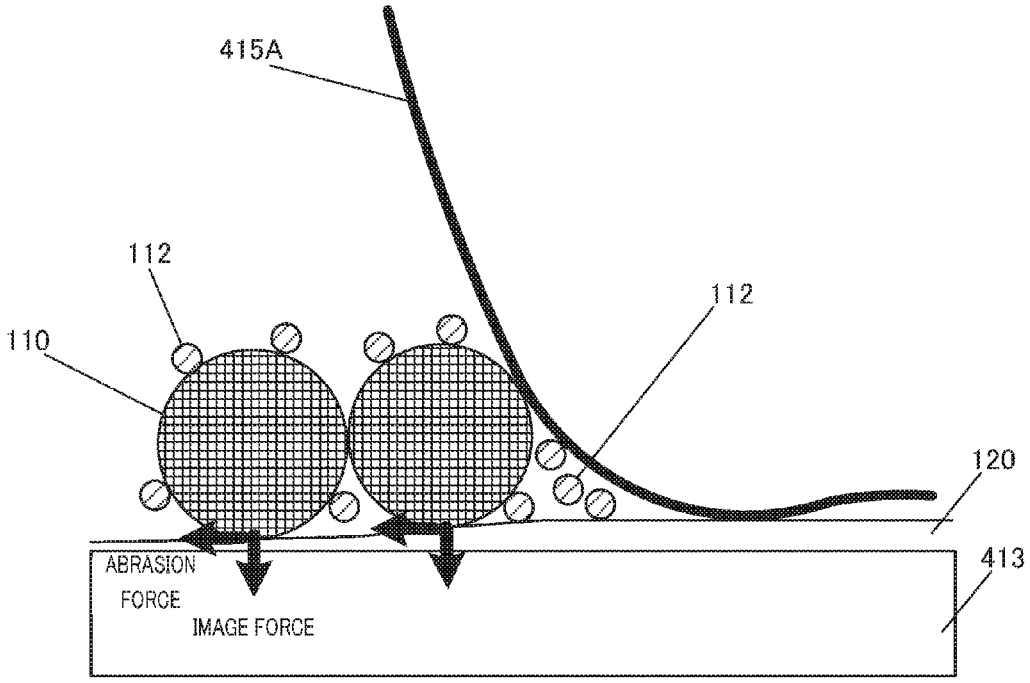

FIG. 4B illustrates a state where toner 110 rolls at the edge of drum cleaning blade 415A and thus lubricant particle 112 supplied together with toner 110 is removed from toner 110 and supplied to lubricant 120 applied on the surface of photoconductor drum 413 when the absolute value of the charging amount of toner 110 is low and the relationship of abrasion effect<supply effect is satisfied.

Figure 5:
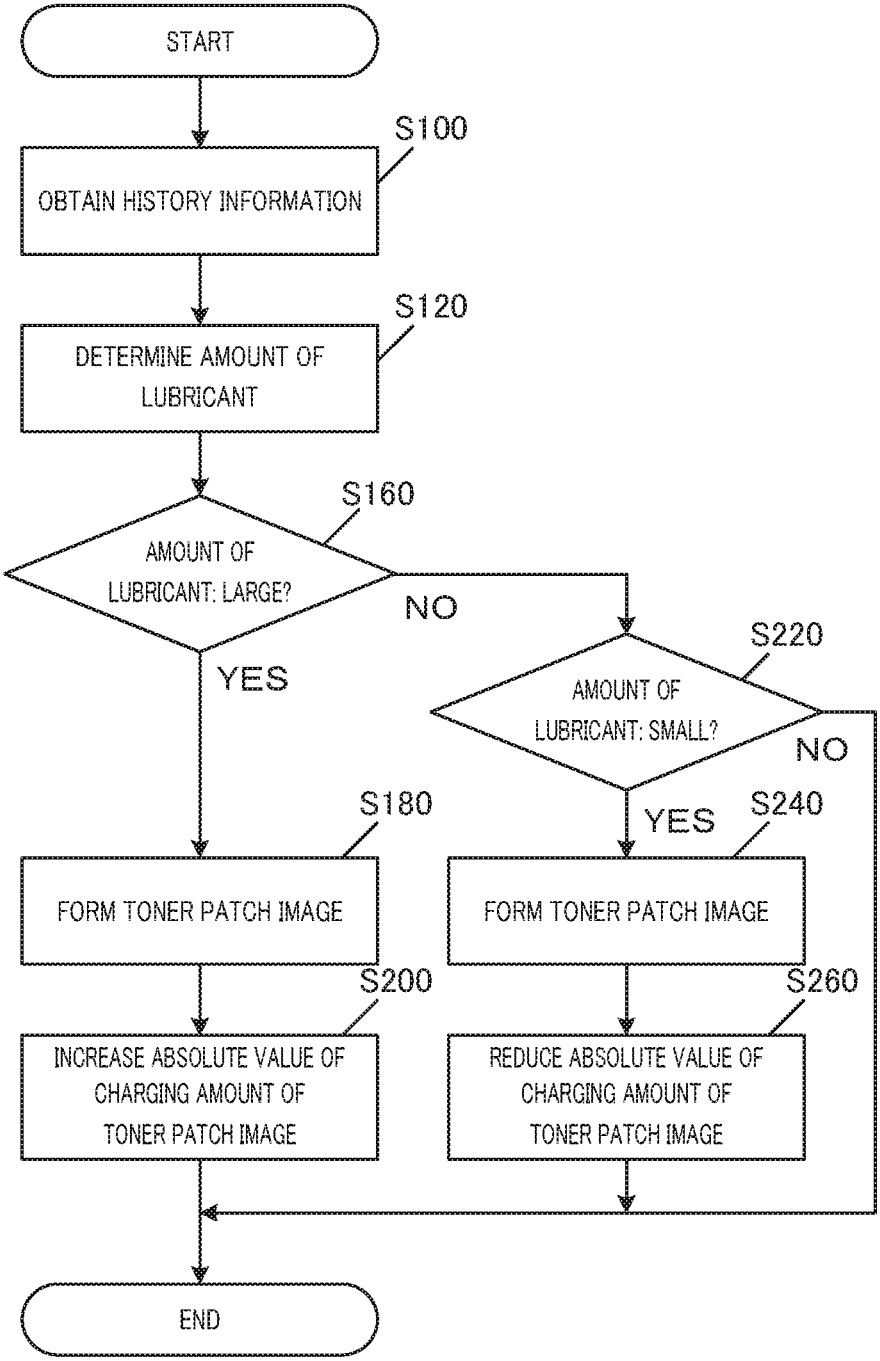
FIG. 5 is a flowchart of a charging amount adjusting operation of the image forming apparatus according to the embodiment.

FIG. 5 is a flowchart of an exemplary charging amount adjusting operation of image forming apparatus 1 of the present embodiment. The processes of steps in FIG. 5 are performed every time when the power of image forming apparatus 1 is turned on and an image formation process based on the printing job is executed.

First, control section 100 acquires history information stored in storage section 72 (step S100). Next, control section 100 refers to the acquired history information, and determines the amount of the lubricant that has been applied on the surface of photoconductor drum 413 by the preceding image formation process (step S120). When an image having a low coverage rate has been formed by the image formation process, control section 100 determines that the amount of the lubricant applied on the surface of photoconductor drum 413 is small. On the other hand, when an image having a high coverage rate has been formed by the image formation process, control section 100 determines that the amount of the lubricant applied on the surface of photoconductor drum 413 is large. Alternatively, control section 100 may determine the amount of the lubricant in accordance with a table which is preliminarily provided in consideration of the estimated variation of the amount of the lubricant on the basis of the coverage rate of the toner image formed by the printing job and the number of sheets to be printed.

When it is determined that the amount of the lubricant applied on the surface of photoconductor drum 413 is large (YES at step S160), control section 100 controls image forming section 40 to form a toner patch image in a patch formation region (step S180). Finally, control section 100 controls charging amount adjusting section 416 such that the absolute value of the charging amount of the formed toner patch image is high (step S200). In this manner, the amount of the lubricant on photoconductor drum 413 can be prevented from excessively reduced even in the case where lubricant 120 applied on the surface of photoconductor drum 413 is scraped by lubricant particle 112 supplied together with toner 110, and thus, the amount of the lubricant can be maintained within a proper range. Upon completion of the process of step S200, image forming apparatus 1 terminates the processing of FIG. 5.

Meanwhile, when it is determined that the amount of the lubricant applied on the surface of photoconductor drum 413 is not large (No at step S160), but is small (YES at step S220), control section 100 controls image forming section 40 to form a toner patch image in the patch formation region (step S240). Finally, control section 100 controls charging amount adjusting section 416 such that the absolute value of the charging amount of the formed toner patch image is small (step S260). In this manner, the amount of the lubricant on photoconductor drum 413 can be prevented from excessively increased even when lubricant particle 112 supplied together with toner 110 is removed from toner 110 and supplied to lubricant 120 applied on the surface of photoconductor drum 413, and thus the amount of the lubricant can be maintained within a proper range. Upon completion of the process of step S260, image forming apparatus 1 terminates the processing of FIG. 5.

When it is determined that the amount of the lubricant applied on the surface of photoconductor drum 413 is not large (NO at step S160), and not small (NO at step S220), image forming apparatus 1 terminates the processing of FIG. 5 since, in this case, the amount of the lubricant on photoconductor drum 413 is maintained within a proper range, and the abrasion effect or the supply effect through formation of the toner patch image is not desired.

As has been described in detail, image forming apparatus 1 of the embodiment includes: photoconductor drum 413 which is rotatable; image forming section 40 configured to form a toner image on photoconductor drum 413 with use of toner mixed with lubricant, and apply a transfer bias when the toner image passes through a transfer nip to transfer the toner image to intermediate transfer belt 421; toner patch image formation section (image forming section 40) configured to form a toner patch image with use of the toner mixed with the lubricant in a patch formation region located between toner image formation regions in a rotational direction of photoconductor drum 413 on a surface of photoconductor drum 413; drum cleaning blade 415A configured to make contact with photoconductor drum 413 and remove toner which remains on photoconductor drum 413 without being transferred to intermediate transfer belt 421; charging amount adjusting section 416 provided on an upstream side of drum cleaning blade 415A in the rotational direction of photoconductor drum 413, and configured to adjust a charging amount of the toner patch image formed by the toner patch image formation section; storage section 72 configured to store history information representing a history of formation of the toner image of the image forming section 40; and control section 100 configured to determine an amount of the lubricant to be applied to a surface of photoconductor drum 413 on a basis of the history information stored in storage section 72, and in accordance with a result thus determined, adjust the charging amount of the toner patch image.

According to the above-mentioned configuration of the present embodiment, the amount of the lubricant to be applied to the surface of photoconductor drum 413 is determined on the basis of the history of the formation of the toner image, and the charging amount of the toner patch image that is formed by the toner patch image formation section and reaches drum cleaning blade 415A is adjusted in accordance with the result of the determination. With this configuration, in accordance with the result of determination on the amount of the lubricant to be applied to the surface of photoconductor drum 413, the abrasion effect or the supply effect or both of the toner patch image (that is, toner mixed with lubricant) can be surely obtained as desired, and the amount of the lubricant to be applied to photoconductor drum 413 can be maintained within a proper range.

It is to be noted that in the above-mentioned embodiment, control section 100 may operate such that the primary transfer bias to be applied at the time when the toner patch image formed in the patch formation region passes through the primary transfer nip is smaller than the primary transfer bias to be applied at the time when the toner image formed in the toner image formation region passes through the primary transfer nip. Examples of the approach for reducing the primary transfer bias include reducing or cutting the primary transfer bias, setting the polarity of the primary transfer bias to a polarity same as that of the toner, and the like. With the above-mentioned configuration, transfer of the toner patch image to intermediate transfer belt 421 is reduced, that is, the amount of the toner patch image that reaches drum cleaning blade 415A is increased, and thus the abrasion effect and the supply effect of the toner patch image can be facilitated. For example, when the amount of the toner patch image that reaches drum cleaning blade 415A is increased, the abrasion effect of the lubricant film on photoconductor drum 413 is increased in proportion to the surface area of the toner of the toner patch image. In addition, when the amount of the toner patch image that reaches drum cleaning blade 415A is increased, the amount of the lubricant conveyed together with the toner is also increased, and as a result, the supply effect of the lubricant on photoconductor drum 413 is increased.

In addition, in the above-mentioned embodiment, control section 100 may operate such that the area of the toner patch image formed in the patch formation region on photoconductor drum 413 is large in the case where the coverage rate of the toner image formed in the toner image formation region is small in comparison with the case where the coverage rate of the toner image is large on the basis of the history information stored in storage section 72. In this manner, by increasing the toner amount of the toner patch image after a toner image having a low coverage rate is formed, the supply effect of the lubricant on photoconductor drum 413 can be increased. Furthermore, in developing device 412, old toner having a small amount of lubricant can be replaced with new toner having a large amount of lubricant.

While intermediate transfer belt 421 corresponds to "second image bearing member" of the embodiment of the present invention in the above-mentioned embodiment, sheet S may correspond to "second image bearing member" of the embodiment of the present invention.

The embodiment disclosed herein are merely exemplifications and should not be considered as limitative. While the invention made by the present inventor has been specifically described based on the preferred embodiment, it is not intended to limit the present invention to the above-mentioned preferred embodiment but the present invention may be further modified within the scope and spirit of the invention defined by the appended claims.

The present invention is applicable to an image formation system composed of a plurality of units including an image forming apparatus. The units include, for example, a post-processing apparatus, an external apparatus such as a control apparatus connected with a network, and the like.

Finally, results of experiments performed by the present inventor for confirming the effectiveness of the above-mentioned embodiment will be described.

Configurations of Image Forming Apparatuses According to Examples 1 to 4 and Comparative Examples 1 and 2

Image forming apparatus 1 having the configuration illustrated in FIGS. 1 and 2 was used as the image forming apparatuses according to Examples 1 to 4 and Comparative examples 1 and 2. The photoconductor drum, the developing device, the transfer device, the toner, the drum cleaning blade and the like were set as follows.

(1) Photoconductor Drum

The photoconductor drum used herein is an organic photoconductor having a drum-shape. The organic photoconductor has a configuration in which a photosensitive layer made of polycarbonate resin and having a thickness of 25 μm is formed on the outer peripheral surface of a metal base made of aluminum and having a drum-shape. The photoconductor drum rotates at 400 mm/second.

(2) Developing Device

The developing device used herein has a developing sleeve that is driven into rotation at a linear velocity of 600 mm per minute. The developing device used herein has a configuration in which a developing bias having a polarity same as that of the surface of the photoconductor drum is applied to the developing sleeve and reversal development is performed by a two-component developer.

(3) Transfer Device

The intermediate transfer belt used herein is an endless belt made of a polyimide resin having conductivity. A primary transfer roller that makes pressure contact with a photoconductor drum with the belt therebetween is provided, and a primary transfer bias having a polarity opposite to the charging polarity of the toner is applied to the primary transfer roller.

(4) Drum Cleaning Blade

The drum cleaning blade used herein is made of urethane rubber, and has an impact resilience coefficient of 50% (25° C.), a JISA hardness of 70 degrees, a thickness of 2.00 mm, a free length of 10 mm, and a width of 324 mm. The drum cleaning blade is set to have a contact load of 20 N/m and a contact angle of 15 degrees with respect to the photoconductor drum.

(5) Toner

The toner of the two-component developer used herein is produced by an emulsion polymerization method and composed of toner particles having a volume-mean particle diameter of 6.5 μm. The toner of the two-component developer used herein has negative charging property. As lubricant, 0.2 pts. wt. of zinc stearate based on the toner is added to the toner particles.

In the above-mentioned image forming apparatus, the surface potential of the photoconductor drum in the non-light exposure region was set to −750 V, the surface potential of the photoconductor drum in the light exposure region was set to −100 V, and a developing bias having a frequency of 6000 Hz, an amplitude of 800 V, and a direct-current component of −550 V was applied to the developing sleeve.

Experimental Method and Result of Experiment in Example 1

The primary transfer bias was set to +500 V, and a state where the transfer efficiency is 95% or greater was established. In this experiment, toner images were formed on 5,000 A4-sheets, and toner patch images were also formed. The toner patch image was formed between toner image formation regions with toner corresponding to 5% of a toner image (normal image) in a pattern elongated in the axial direction of the photoconductor drum. The primary transfer bias to be applied was not changed even when the toner patch image passes through the primary transfer nip, and the toner patch image was transferred to the intermediate transfer belt. First, when the coverage rate of the previously formed toner image was 45% or greater, the charging amount of the toner patch image before reaching the drum cleaning blade (toner adhesion amount: 0.5 g/m$^2$) was adjusted to −45 μC/g or +45 μC/g. As a result, turn-up of the blade due to an excessive amount of the lubricant was not caused until the coverage rate of the toner image exceeded 60%.

Next, when the coverage rate of the previously formed toner image was 10% or smaller, the charging amount of the toner patch image before reaching the drum cleaning blade (toner adhesion amount: 0.5 g/m$^2$) was adjusted to −10 μC/g or +10 μC/g. As a result, until the coverage rate of the toner image became lower than 7%, grain unevenness due to an insufficient amount of the lubricant was not caused.

Table 1 shows degrees of turn-up of the blade and grain unevenness in Examples 1 to 3 and Comparative example 1. In Table 1, "turn-up" means that turn-up of the blade was caused, "grain" means that grain unevenness was caused, and "o" means that neither of turn-up of the blade and grain unevenness was caused.

TABLE 1

| | Toner patch image | | | Coverage rate | | | | | | | | |
|---|---|---|---|---|---|---|---|---|---|---|---|---|
| | Adhesion amount | | Charging amount | | | | | | | | | |
| | g/m$^2$ | Printing area | μC/g | 100% | 90% | 80% | 70% | 60% | 50% | 45% | 40% | 30% |
| Ex. 1 | 0.5 | Corresponding to 5% | −45 | | | turn-up | turn-up | o | o | o | | |
| | | | +45 | | | turn-up | turn-up | o | o | o | | |
| | | | −10 | | | | | | | | | |
| | | | +10 | | | | | | | | | |
| Ex. 2 | 5.0 | | −25 | | | | turn-up | turn-up | o | o | o | o |
| | | | −40 | o | o | o | o | o | o | o | | |
| | | | −10 | | | | | | | | | |
| Ex. 3 | | Corresponding to 10% | −10 | | | | | | | | | |
| Comp. EX. 1 | | Corresponding to 5% | −25 | | | | | turn-up | turn-up | o | o | o |

| | Toner patch image | | | Coverage rate | | | | | | | | |
|---|---|---|---|---|---|---|---|---|---|---|---|---|
| | Adhesion amount | | Charging amount | | | | | | | | | |
| | g/m$^2$ | Printing area | μC/g | 20% | 15% | 10% | 7% | 5% | 3% | 1.5% | 1% | 0% |
| Ex. 1 | 0.5 | Corresponding to 5% | −45 | | | | | | | | | |
| | | | +45 | | | | | | | | | |
| | | | −10 | | | o | o | grain | grain | | | |
| | | | +10 | | | o | o | grain | grain | | | |
| Ex. 2 | 5.0 | | −25 | o | o | o | o | grain | grain | | | |
| | | | −40 | | | | | | | | | |
| | | | −10 | | | o | o | o | grain | grain | | |
| Ex. 3 | | Corresponding to 10% | −10 | | | o | o | o | o | o | o | o |
| Comp. EX. 1 | | Corresponding to 5% | −25 | o | o | o | grain | grain | | | | |

Experimental Method and Result of Experiment in Example 2

The abrasion effect and the supply effect of the lubricant on the photoconductor drum can be increased by increasing the amount of the toner of the toner patch image that reaches the drum cleaning blade. In view of this, in Example 2, the area of the toner patch image formed in the patch formation region was set to an area corresponding to 5% of the coverage rate of the toner image, which is equal to that of Example 1, and the primary transfer bias which is applied at the time when the toner patch image passes through the primary transfer nip was set to −500 V so as to leave a toner patch image on the photoconductor drum.

First, regardless of the coverage rate of the previously formed toner image, the charging amount of the toner patch image before reaching the drum cleaning blade (toner adhesion amount: 5.0 g/m$^2$) was not adjusted. In this case, the charging amount of the toner patch image before reaching the drum cleaning blade (toner adhesion amount: 0.5 g/m$^2$) was −25 μC/g. As a result, until the coverage rate of the toner image exceeded 50%, turn-up of the blade due to an excessive amount of the lubricant was not caused. In addition, until the coverage rate of the toner image became lower than 7%, grain unevenness due to an insufficient amount of the lubricant was not caused.

Next, when the coverage rate of the previously formed toner image was 45% or greater, the charging amount of the toner patch image before reaching the drum cleaning blade (toner adhesion amount: 5.0 g/m$^2$) was adjusted to −45 μC/g. As a result, turn-up of the blade due to an excessive amount of the lubricant was not caused until the coverage rate of the toner image became 100%.

Finally, when the coverage rate of the previously formed toner image was 10% or smaller, the charging amount of the toner patch image before reaching the drum cleaning blade (toner adhesion amount: 5.0 g/m$^2$) was adjusted to −10 μC/g. As a result, until the coverage rate of the toner image became lower than 5%, grain unevenness due to an insufficient amount of the lubricant was not caused.

Experimental Method and Result of Experiment in Example 3

According to the result of the experiment of Example 2, generation of grain unevenness was not completely prevented on the low coverage rate side. In view of this, for the purpose of completely preventing generation of grain unevenness on the low coverage rate side by replacing the toner in the developing device to increase the amount of the lubricant in the developing device, the printing area of the toner patch image was increased to an area corresponding to 10% of the toner image (normal image), and the primary transfer bias at the time when the toner patch image passes through the primary transfer nip was set to −500 V in the case where the coverage rate of the previously formed toner image was 10% or lower.

In addition, the charging amount of the toner patch image to be supplied to the drum cleaning blade (toner adhesion amount: 5.0 g/m$^2$) was adjusted to an amount lower than that of a normal state (−25 μC/g). Since the printing area of the toner patch image was more than double the printing area of the toner patch image of Example 2, the sum of the toner amount of the toner patch image was also more than double the sum of the toner amount of Example 2. As a result, until the coverage rate of the toner image became 0%, grain unevenness due to an insufficient amount of the lubricant was not caused.

Experimental Method and Result of Experiment in Comparative Example 1

The primary transfer bias was set to +500 V, and a state where the transfer efficiency is 95% or greater was established. In this experiment, toner images were formed on 5,000 A4-sheets, and toner patch images were also formed. The toner patch image was formed between toner image formation regions with toner corresponding to 5% of a toner image (normal image) in a pattern elongated in the axial direction of the photoconductor drum. The primary transfer bias to be applied was not changed even when the toner patch image passes through the primary transfer nip, and the toner patch image was transferred to the intermediate transfer belt. Regardless of the coverage rate of the previously formed toner image, the charging amount of the toner patch image before reaching the drum cleaning blade (toner adhesion amount: 0.5 g/m$^2$) was not adjusted. In this case, the charging amount of the toner patch image before reaching the drum cleaning blade was −25 μC/g. As a result, when the coverage rate of the toner image is 0 to 45%, neither of turn-up of the blade and grain unevenness was caused. However, when the coverage rate of the toner image was 50% or greater, turn-up of the blade due to an excessive amount of the lubricant was caused. In addition, when the coverage rate of the toner image was 7% or smaller, grain unevenness due to an insufficient amount of the lubricant was caused.

As described above, in Example 1, the operating window was expanded to the high coverage rate side and the low coverage rate side in comparison with Comparative example 1. At the same time, by adjusting the absolute value of the charging amount of the toner patch image that reaches the drum cleaning blade, the abrasion effect or the supply effect or both was surely obtained as desired. In addition, in Example 2, by increasing the toner amount of the toner patch image that reaches the drum cleaning blade, generation of turn-up of the blade and grain unevenness could be suppressed in a wider range of the coverage rate in comparison with Example 1 and Comparative example 1. In addition, in Example 3, by increasing the printing area of the toner patch image and setting the primary transfer bias to be applied at the time when the toner patch image passes through the primary transfer nip to −500 V, generation of turn-up of the blade and grain unevenness could be suppressed in a wide coverage rate of 0% to 100%.

Experimental Method and Result of Experiment in Example 4

It was confirmed from the results of the experiments in Examples 1 to 3 that by adjusting the charging amount of the toner patch image in accordance with the coverage rate of the previously formed toner image, generation of turn-up of the blade and grain unevenness could be suppressed in a wide coverage rate. In Example 4, the charging amount of the toner patch image was adjusted in accordance with the variation in the amount of the lubricant on the photoconductor drum in the case where different printing jobs were performed, that is, in the case where toner images having different coverage rates were formed. To be more specific, for the purpose of creating large variation in the amount of the lubricant in the developing device, formation of a toner image having a coverage rate of 85% on 10,000 A4-sheets and formation of a toner image having a coverage rate of 5% on 10,000 A4-sheets were repeated to form toner images on 50,000 A4-sheets. From the result of examination on the amount of the lubricant in the developing device in the experiments in Examples 1 to 3 and Comparative example 1, it was found that the supply and ejection of the lubricant in the developing device were balanced and stabilized after images were formed on about 5,000 sheets regardless of whether the coverage rate was low or high. In view of this, in consideration of the variation in the amount of the lubricant in the developing device and the variation in the amount of the lubricant on the photoconductor drum in association with the variation in the amount of the lubricant in the developing device, when the average coverage rate of the previously formed toner images on 5,000 sheets reached a predetermined value, the charging amount of the toner patch image was adjusted on the basis of the result of Example 3 (see Table 2). The primary transfer bias that is applied at the time when the toner patch image passes through the primary transfer nip was set to −500 V so as to leave a toner patch image on the photoconductor drum. On the other hand, in Comparative example 2, the charging amount of the toner patch image was not adjusted unlike Example 4.

TABLE 2

| Coverage rate (after printing 5,000 sheets) | Adhesion amount g/m$^2$ | Printing area | Charging amount μC/g |
|---|---|---|---|
| 45% or greater | 0.5 | Corresponding to 5% | −45 |
| 10% or greater and smaller than 45% | | | −25 |
| smaller than 10% | | Corresponding to 10% | −10 |

Table 3 shows degrees of turn-up of the blade and grain unevenness in Example 4 and Comparative example 2. In Table 3, "turn-up" means that turn-up of the blade was caused, "grain" means that grain unevenness was caused, and "o" means that neither of turn-up of the blade and grain unevenness was caused.

TABLE 3

| | Control | Image formation pattern (every 10,000 sheets) | Quality problem | | | | |
|---|---|---|---|---|---|---|---|
| | | | 10,000 sheets | 20,000 sheets | 30,000 sheets | 40,000 sheets | 50,000 sheets |
| Ex. 4 | Charging amount is controlled in average coverage rate of previous 5,000 sheets | 85% → 5% → 85% → 5% → 85% | o | o | o | o | o |
| | | 5% → 85% → 5% → 85% → 5% | o | o | o | o | o |
| Comp Ex. 2 | No charging amount adjustment control | 85% → 5% → 85% → 5% → 85% | turn-up | | | | |
| | | 5% → 85% → 5% → 85% → 5% | grain | | | | |

In Comparative example 2, before toner images were formed on 10,000 sheets, turn-up of the blade due to an excessive amount of the lubricant, or, grain unevenness due to an insufficient amount of the lubricant was caused. On the other hand, in Example 4, generation of turn-up of the blade and grain unevenness could be suppressed.

The invention claimed is:

1. An image forming apparatus comprising:

a first image bearing member which is rotatable;

an image forming section configured to form a toner image on the first image bearing member with use of toner mixed with lubricant, and apply a transfer bias when the toner image passes through a transfer nip to transfer the toner image to a second image bearing member;

a toner patch image formation section configured to form a toner patch image with use of the toner mixed with the lubricant in a patch formation region located between toner image formation regions in a rotational direction of the first image bearing member on a surface of the first image bearing member;

a cleaning member configured to make contact with the first image bearing member and remove toner which remains on the first image bearing member without being transferred to the second image bearing member;

a charging amount adjusting section provided on an upstream side of the cleaning member in the rotational direction of the first image bearing member, and configured to adjust a charging amount of the toner patch image formed by the toner patch image formation section;

a storage section configured to store history information representing a history of formation of the toner image of the image forming section; and a control section configured to determine an amount of the lubricant to be applied to a surface of the first image bearing member on a basis of the history information stored in the storage section, and in accordance with a result thus determined, adjust the charging amount of the toner patch image.

2. The image forming apparatus according to claim 1, wherein, when it is determined that the amount of the lubricant to be applied to the surface of the first image bearing member is large, the control section adjusts the charging amount such that an absolute value of the charging amount of the toner patch image formed by the toner patch image formation section is greater than an absolute value of a charging amount of a toner patch image which reaches the cleaning member without being subjected to adjustment of the charging amount.

3. The image forming apparatus according to claim 1, wherein, when it is determined that the amount of the lubricant to be applied to the surface of the first image bearing member is small, the control section adjusts the charging amount such that an absolute value of the charging amount of the toner patch image formed by the toner patch image formation section is smaller than an absolute value of a charging amount of a toner patch image which reaches the cleaning member without being subjected to adjustment of the charging amount.

4. The image forming apparatus according to claim 1, wherein the control section operates such that the transfer bias that is applied at a time when the toner patch image formed by the toner patch image formation section passes through the transfer nip is smaller than the transfer bias that is applied at a time when the toner image formed by the image forming section passes through the transfer nip.

5. The image forming apparatus according to claim 1, wherein, when a coverage rate of the toner image formed by the image forming section is small, the control section operates such that an area of the toner patch image to be formed on the first image bearing member is large in comparison with a case where the coverage rate of the toner image is large on a basis of the history information stored in the storage section.

6. An image formation system composed of a plurality of units including an image forming apparatus, the image formation system comprising:

a first image bearing member which is rotatable;

an image forming section configured to form a toner image on the first image bearing member with use of toner mixed with lubricant, and apply a transfer bias when the toner image passes through a transfer nip to transfer the toner image to a second image bearing member;

a toner patch image formation section configured to form a toner patch image with use of the toner mixed with the lubricant in a patch formation region located between toner image formation regions in a rotational direction of the first image bearing member on a surface of the first image bearing member;

a cleaning member configured to make contact with the first image bearing member and remove toner which remains on the first image bearing member without being transferred to the second image bearing member;

a charging amount adjusting section provided on an upstream side of the cleaning member in the rotational direction of the first image bearing member, and configured to adjust a charging amount of the toner patch image formed by the toner patch image formation section;

a storage section configured to store history information representing a history of formation of the toner image of the image forming section; and a control section configured to determine an amount of the lubricant to be applied to a surface of the first image bearing member on a basis of the history information stored in the storage section, and in accordance with a result thus estimated, adjust the charging amount of the toner patch image.

7. The image formation system according to claim 6, wherein, when it is determined that the amount of the lubricant to be applied to the surface of the first image bearing member is large, the control section adjusts the charging amount such that an absolute value of the charging amount of the toner patch image formed by the toner patch image formation section is greater than an absolute value of a charging amount of a toner patch image which reaches the cleaning member without being subjected to adjustment of the charging amount.

8. The image formation system according to claim 6, wherein, when it is determined that the amount of the lubricant to be applied to the surface of the first image bearing member is small, the control section adjusts the charging amount such that an absolute value of the charging amount of the toner patch image formed by the toner patch image formation section is smaller than an absolute value of a charging amount of a toner patch image which reaches the cleaning member without being subjected to adjustment of the charging amount.

9. The image formation system according to claim 6, wherein the control section operates such that the transfer bias that is applied at a time when the toner patch image formed by the toner patch image formation section passes through the transfer nip is smaller than the transfer bias that is applied at a time when the toner image formed by the image forming section passes through the transfer nip.

10. The image formation system according to claim 6, wherein the control section operates such that an area of the toner patch image to be formed on the first image bearing member is large in comparison with a case where the coverage rate of the toner image is large when a coverage rate of the toner image formed by the image forming section is small on a basis of the history information stored in the storage section.

11. A method of controlling an image forming apparatus, the image forming apparatus including:

a first image bearing member which is rotatable;

an image forming section configured to form a toner image on the first image bearing member with use of toner mixed with lubricant, and apply a transfer bias when the toner image passes through a transfer nip to transfer the toner image to a second image bearing member;

a toner patch image formation section configured to form a toner patch image with use of the toner mixed with the lubricant in a patch formation region located between toner image formation regions in a rotational direction of the first image bearing member on a surface of the first image bearing member; and a cleaning member configured to make contact with the first image bearing member and remove toner which remains on the first image bearing member without being transferred to the second image bearing member, the method comprising:

determining an amount of the lubricant to be applied to a surface of the first image bearing member on a basis of history information representing a history of formation of the toner image of the image forming section; and adjusting the charging amount of the toner patch image formed by the toner patch image formation section in accordance with a result of the determining.

12. The method according to claim 11, wherein, when it is determined that the amount of the lubricant to be applied to the surface of the first image bearing member is large, the charging amount is adjusted such that an absolute value of the charging amount of the toner patch image formed by the toner patch image formation section is greater than an absolute value of a charging amount of a toner patch image which reaches the cleaning member without being subjected to adjustment of the charging amount.

13. The method according to claim 11, wherein, when it is determined that the amount of the lubricant to be applied to the surface of the first image bearing member is small, the charging amount is adjusted such that an absolute value of the charging amount of the toner patch image formed by the toner patch image formation section is smaller than an absolute value of a charging amount of a toner patch image which reaches the cleaning member without being subjected to adjustment of the charging amount.

14. The method according to claim 11, wherein the transfer bias that is applied at a time when the toner patch image formed by the toner patch image formation section passes through the transfer nip is set to a value smaller than the transfer bias that is applied at a time when the toner image formed by the image forming section passes through the transfer nip.

15. The method according to claim 11, wherein, when a coverage rate of the toner image formed by the image forming section is small, the toner patch image to be formed on the first image bearing member is set to have a large area in comparison with a case where the coverage rate of the toner image is large on a basis of the history information stored in the storage section.

* * * * *